US010247150B1

(12) United States Patent
Koplitz et al.

(10) Patent No.: US 10,247,150 B1
(45) Date of Patent: Apr. 2, 2019

(54) OUTBOARD MOTOR POWERHEAD SECTION AND FUEL DELIVERY SYSTEM

(71) Applicant: Brunswick Corporation, Lake Forest, IL (US)

(72) Inventors: Wesley D. Koplitz, Oshkosh, WI (US); Jody A. Peterson, Oshkosh, WI (US); Michael A. Torgerud, Mt. Calvary, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 15/495,224

(22) Filed: Apr. 24, 2017

(51) Int. Cl.

| | |
|---|---|
| ***F02M 69/46*** | (2006.01) |
| ***F02M 37/00*** | (2006.01) |
| ***F02B 61/04*** | (2006.01) |
| ***F02B 75/22*** | (2006.01) |
| ***F02M 35/16*** | (2006.01) |

(Continued)

(52) U.S. Cl.
CPC ..... *F02M 37/0017* (2013.01); *B63H 20/001* (2013.01); *F02B 61/045* (2013.01); *F02B 75/22* (2013.01); *F02M 35/116* (2013.01); *F02M 35/167* (2013.01); *F02M 55/025* (2013.01); *B63B 2758/00* (2013.01); *B63B 2770/00* (2013.01)

(58) Field of Classification Search
CPC ..... F02M 63/0275; F02M 63/028; F02M 63/0285; F02M 63/029; F02M 63/0295; F02M 35/165; F02M 35/167; F02M 35/168; F02M 35/10; F02M 35/10209; F02M 35/10216
See application file for complete search history.

(56) References Cited

U.S. PATENT DOCUMENTS 4,702,202 A 10/1987 Hensel et al.
5,030,116 A 7/1991 Sakai et al.
(Continued)

FOREIGN PATENT DOCUMENTS

EP 1903211 A2 3/2008

OTHER PUBLICATIONS

Mercury Marine, photographs of F2 injector cup, admitted prior art.
(Continued)

*Primary Examiner* — Andrew Polay
(74) *Attorney, Agent, or Firm* — Andrus Intellectual Property Law, LLP

(57) ABSTRACT

An outboard motor engine has a cylinder block including vertically stacked cylinders divided into two cylinder banks arranged in a V-shape. Two cylinder heads define intake passages, each intake passage corresponding to a respective cylinder. Air intake manifolds include air intake runners that extend from an opposite end of the engine, around outer sides of the cylinder block, and respectively connect to the intake passages. Two vertically extending fuel rails are respectively located between the first cylinder head and the first air intake manifold and between the second cylinder head and the second air intake manifold. The fuel rails are integral with either the respective cylinder heads, or the respective air intake manifolds. Fuel injectors are coupled to the fuel rails and vertically spaced from one another with respect to each fuel rail such that each fuel injector is associated with a respective cylinder.

20 Claims, 10 Drawing Sheets

(51) Int. Cl.

| | |
|---|---|
| ***F02M 35/116*** | (2006.01) |
| ***F02M 55/02*** | (2006.01) |
| ***B63H 20/00*** | (2006.01) |

(56) References Cited

U.S. PATENT DOCUMENTS

| | | | | |
|---|---|---|---|---|
| 5,070,844 | A * | 12/1991 | Daly | F02M 51/005 123/456 |
| 5,097,594 | A | 3/1992 | Daly et al. | |
| 5,127,382 | A | 7/1992 | Imoehl | |
| 5,138,983 | A | 8/1992 | Daly | |
| 5,197,435 | A | 3/1993 | Mazur et al. | |
| 5,616,037 | A | 4/1997 | Lorraine et al. | |
| 5,682,859 | A | 11/1997 | Wakeman | |
| 5,785,022 | A | 7/1998 | Haboush, II et al. | |
| 5,894,831 | A | 4/1999 | Takahashi et al. | |
| 5,957,112 | A | 9/1999 | Takahashi et al. | |
| 5,979,414 | A | 11/1999 | Pugh | |
| 6,030,262 | A | 2/2000 | Okamoto et al. | |
| 6,161,527 | A | 12/2000 | Ruman | |
| 6,189,510 | B1 | 2/2001 | Jaeger et al. | |
| 6,405,711 | B1 | 6/2002 | Smith et al. | |
| 6,672,287 | B2 | 1/2004 | Wada et al. | |
| 6,752,114 | B2 | 6/2004 | Ochiai et al. | |
| 6,763,795 | B2 | 7/2004 | Takahashi | |
| 6,843,217 | B2 | 1/2005 | Zwick et al. | |
| 6,843,234 | B1 * | 1/2005 | de Vulpillieres | F02M 35/10216 123/456 |
| 6,957,643 | B2 | 10/2005 | Lee et al. | |
| 7,591,246 | B2 | 9/2009 | Beardmore et al. | |
| 2002/0072281 | A1 * | 6/2002 | Takahashi | F02B 61/045 440/88 F |
| 2005/0051138 | A1 | 3/2005 | Haley et al. | |
| 2005/0133009 | A1 | 6/2005 | Rowells et al. | |

OTHER PUBLICATIONS

Mercury Marine, photograph of L4 NA plastic fuel rail, admitted prior art.

Koplitz et al., "Outboard Motor Powerhead Section and Fuel Delivery System Having Low-Profile Fuel Rail", Unpublished U.S. Appl. No. 15/212,425, filed Jul. 18, 2016.

* cited by examiner

OUTBOARD MOTOR POWERHEAD SECTION AND FUEL DELIVERY SYSTEM

FIELD

The present disclosure relates to fuel delivery systems for outboard motor internal combustion engines.

BACKGROUND

U.S. Pat. No. 4,702,202 discloses a two cycle internal combustion engine having a fuel injection system with a low profile compact intake manifold mounted to the crankcase by an adaptor plate and defining an intake air flow path in a first direction behind the manifold through a gap between the manifold and the crankcase provided by the adaptor plate. Intake air then flows into throttle bore passages from behind the manifold and then reverses direction and flows through supply passages having fuel injectors and then into the crankcase. The passages share a common plenum within the manifold. The fuel injectors, their electrical connectors and a common rigid fuel supply rail are all in the common plenum entirely within the low profile manifold and sealed from moisture and salt in a marine environment.

U.S. Pat. No. 5,070,844 discloses an injector that is mechanically retained in a molded composite socket member by an annular cap that is threaded onto the end of the socket member containing the end of the through-bore into which the injector was inserted. The sidewall of the cap contains an internal helical thread that threads to an external helical thread on the exterior of the socket member. The cap stiffens the socket wall at the thread to strengthen the socket wall against circumferential expansion caused by the pressure of fuel in an annular space that surrounds the injector interior of the socket through-bore. A method for making the cap and joining it to the socket member is also disclosed.

U.S. Pat. No. 5,197,435 discloses an injection molded fuel injection rail for an automotive engine. The fuel rail is designed to supply fuel to a plurality of electromagnetic fuel injectors oriented at acute angles relative to vertical. The socket inlet apertures through which fuel is fed from the rail interior into the respective fuel injector sockets are located in the bottom of the rail. This prevents the ingestion of vapor, which is normally present in the upper portion of the rail, into the injectors. In order to maintain both sides of these socket inlet apertures at substantially the same level, the tilted injector sockets are provided with an occlusive lip along the high side of each inlet aperture. Additionally, the tilted socket axes may be offset laterally downward from the longitudinal rail axis. A plug type fitment is used to close the barrel core pin opening at one end of the rail. It is retained in the opening by a zero compressive load retainer which engages a cooperating annular shoulder structure formed on that end of the rail. To insure uniform distribution of the plastic injected into the mold and to prevent relative movement of the core pins by the force of the injected plastic during the molding process, a sprue site is located above each fuel injector socket in offset parallel alignment with the socket axis.

U.S. Pat. No. 5,785,022 discloses a fuel injector post for connecting a fuel injector to a fuel rail. The fuel injector post comprises a tubular body portion with a central axis having a circumferential wall, an open end and an outlet on the tubular body portion. The fuel injector post further comprises an adapter portion positioned at an angle to the central axis of the tubular body and integral with the outlet on the tubular body portion. The adapter portion has a passage in fluid communication with the tubular body portion and the fuel rail and therefore connects a fuel injector to the side of a fuel rail, which is advantageous to the engine package. Alternatively, the tubular body portion can have a closed end configured and adapted to reduce air entrapment in the tubular body portion to therefore reduce or eliminate pressure waves in the entire fuel system due to entrapped air.

U.S. Pat. No. 6,161,527 discloses a fuel injection system that incorporates a plurality of fuel injection arrangements, wherein each fuel injection is associated with a particular cylinder of the engine. Each of the fuel injection arrangements comprises a fluid passageway in which fuel and air are combined prior to injection into a combustion chamber of the cylinder. A valve is moveable with respect to an injection port to allow the pressurized fuel/air mixture to flow from the fluid passageway into the combustion chamber. A fuel injector is used to inject liquid fuel into the fluid passageway to be combined with pressurized air within the passageway. The system has a common air rail and a common fuel rail which are each connected to a plurality of the fuel injection arrangements. Upward movement of a piston within a cylinder is used to pressurize the air within the common air rail. All of the fuel injection arrangements can be used to contribute pressurized air to the common air rail.

Unpublished U.S. patent application Ser. No. 15/212,425, filed Jul. 18, 2016, which is hereby incorporated by reference herein, discloses an outboard motor powerhead section including an engine having vertically stacked cylinders. The engine includes intake passages extending through the cylinder head to the cylinders. A fuel rail extends along a vertical center axis alongside the cylinder head. Receiver cups are coupled to the fuel rail and vertically spaced from one another such that each receiver cup is associated with a respective cylinder. Each receiver cup has a respective connector passage providing fluid communication between the fuel rail and receiver cup. Fuel injectors are respectively coupled to the receiver cups. Each fuel injector has an inlet end located in a respective receiver cup and extends along a center axis toward a nozzle end that extends into a respective intake passage. A cowl covers the engine. The vertical center axis of the fuel rail is located relatively more inboard with respect to the engine than is at least one connector passage.

SUMMARY

This Summary is provided to introduce a selection of concepts that are further described herein below in the Detailed Description. This Summary is not intended to identify key or essential features from the claimed subject matter, nor is it intended to be used as an aid in limiting the scope of the claimed subject matter.

According to one example of the present disclosure, an outboard motor internal combustion engine includes a cylinder block including a plurality of vertically stacked cylinders that are divided into first and second cylinder banks arranged in a V-shape. First and second cylinder heads are coupled to the first and second cylinder banks, respectively, near a first end of the engine. The first and second cylinder heads define a plurality of intake passages, each intake passage in the plurality of intake passages corresponding to a respective cylinder in the plurality of cylinders. The engine also includes first and second air intake manifolds including a plurality of air intake runners that extend from a second, opposite end of the engine, around first and second sides of the cylinder block, and are respectively connected to the intake passages in the first and second cylinder heads. First and second vertically extending fuel rails are respectively located between the first cylinder head and the first air intake manifold and between the second cylinder head and the second air intake manifold. The first and second fuel rails are integral with either the first and second cylinder heads, respectively, or the first and second air intake manifolds, respectively. A plurality of fuel injectors are coupled to the first and second fuel rails and vertically spaced from one another with respect to each fuel rail such that each fuel injector in the plurality of fuel injectors is associated with a respective cylinder. Each fuel injector has a nozzle end that injects fuel into a respective intake passage corresponding to the respective cylinder.

According to another example of the present disclosure, a fuel delivery system for an outboard motor internal combustion engine is described. The engine has a cylinder block including a plurality of vertically stacked cylinders that are divided into first and second cylinder banks arranged in a V-shape. First and second cylinder heads are coupled to the first and second cylinder banks, respectively, near a first end of the engine and define intake passages corresponding to each of the cylinders. The fuel delivery system includes a fuel source, a fuel pump in fluid communication with the fuel source, and first and second fuel rails in fluid communication with the fuel pump and extending vertically alongside the engine. Fuel injectors are coupled to the first and second fuel rails and vertically spaced from one another with respect to each fuel rail such that each fuel injector is associated with a respective cylinder. Each fuel injector has a nozzle end that injects fuel into a respective intake passage corresponding to the respective cylinder. Flexible feeder tubes extend from the first and second fuel rails, respectively. Each feeder tube is connected to a respective fuel injector. The fuel injectors are top-feed fuel injectors, and each feeder tube is coupled to a respective fuel injector perpendicular to a longitudinal center axis of the respective fuel injector.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed.

Figure 1:
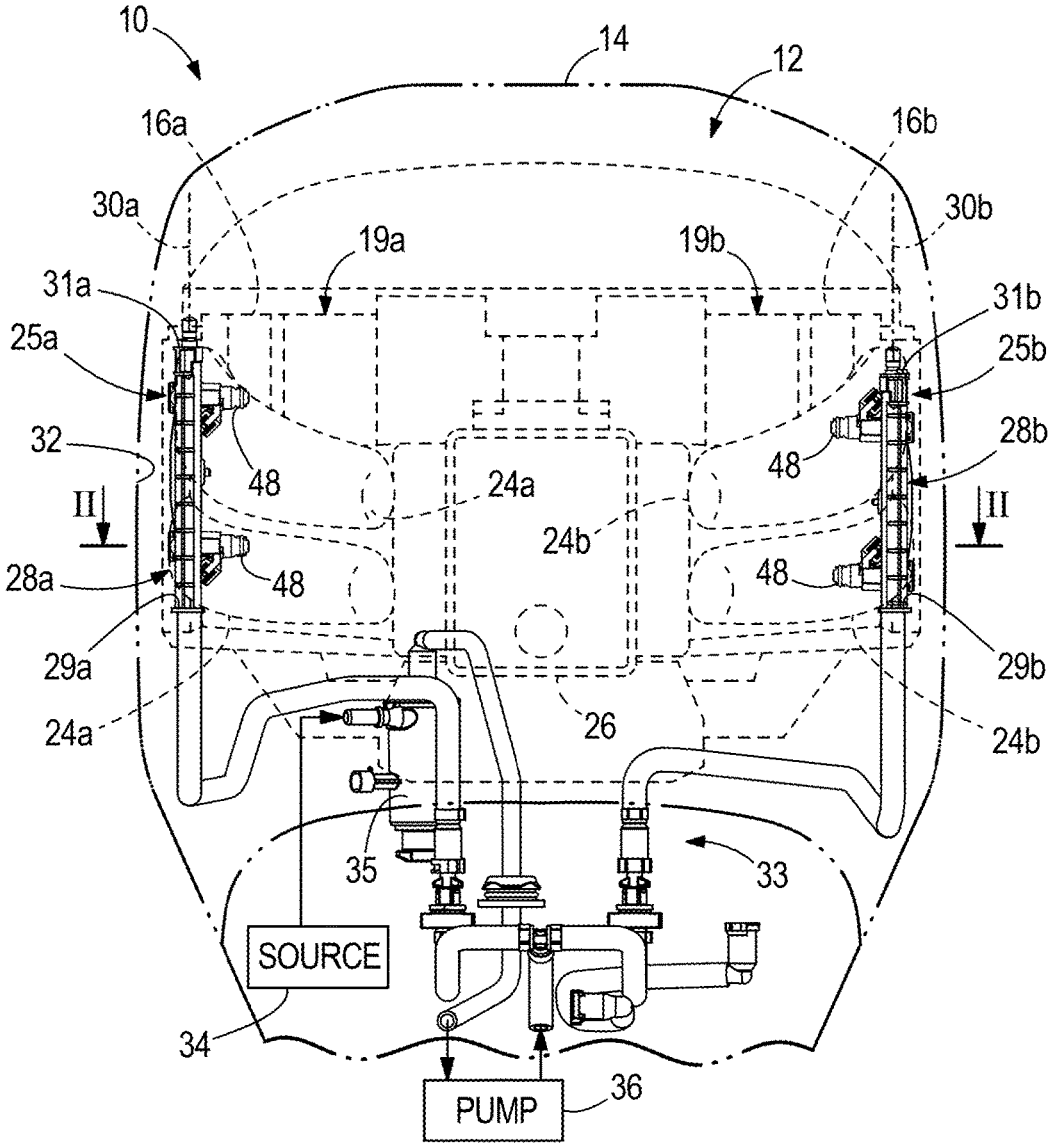
FIG. 1 illustrates a front view of a partially cross-sectioned outboard motor powerhead section according to the present disclosure, with an engine shown schematically in dashed lines and a fuel delivery system shown in solid lines.
Figure 2:
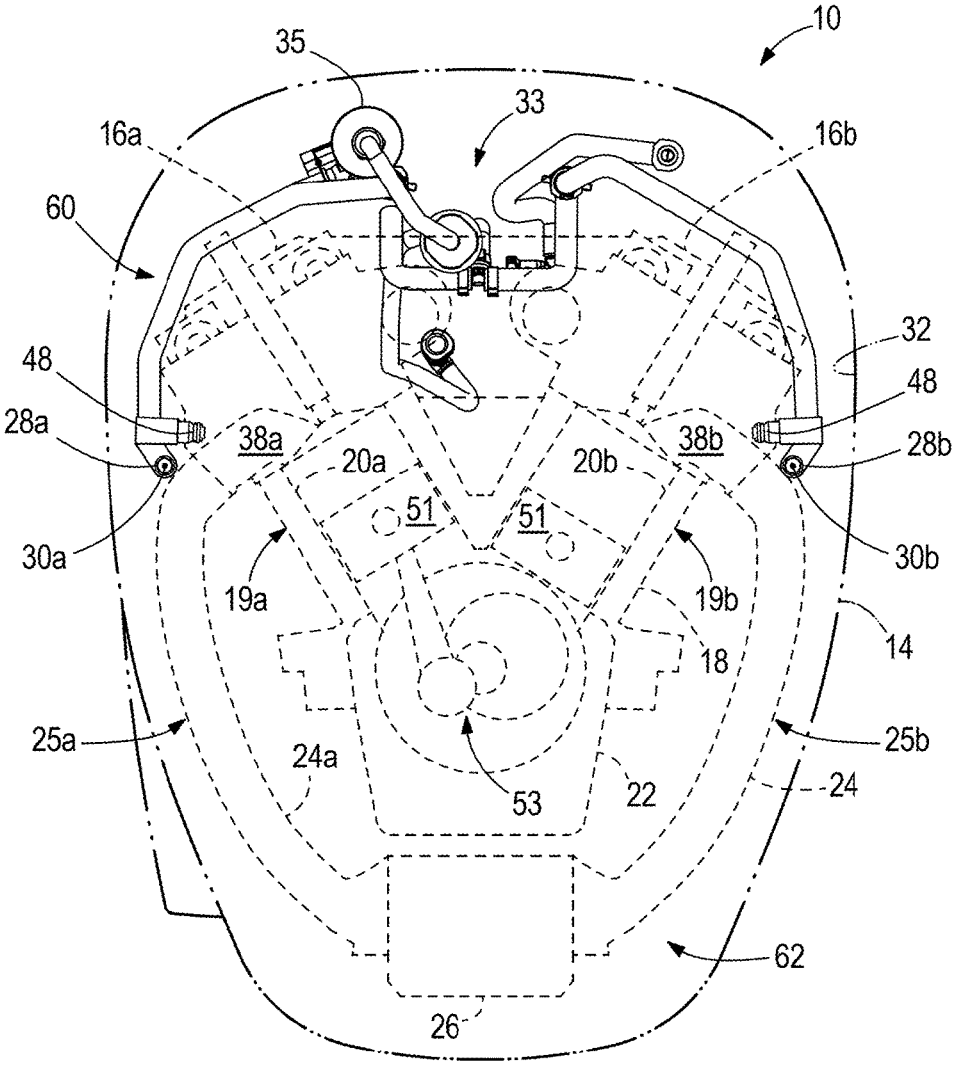
FIG. 2 illustrates a sectional view of the powerhead section, taken along the line II-II of FIG. 1.

FIGS. 1 and 2 illustrate an outboard motor powerhead section 10 for an outboard motor including an internal combustion engine 12 covered by a cowl 14. The internal combustion engine 12 includes two cylinder heads 16*a*, 16*b* coupled to a first end of a cylinder block 18. Each cylinder head 16*a*, 16*b* and the cylinder block 18 together define a number of vertically stacked cylinders 20*a*, 20*b*. Note that the cylinder block 18 shown herein has two banks 19*a*, 19*b* of two cylinders 20*a*, 20*b* each, which banks 19*a*, 19*b* are arranged in a V-shape. The engine 12 therefore is a V-4 engine. In other examples, the engine could be a V-2, V-6, V-8 (FIGS. 4-9), or other type of engine. A crankcase cover 22 is coupled to a second, opposite end of the cylinder block 18 and encloses a vertically oriented crankshaft 53. Two pairs of intake runners 24*a*, 24*b* extend along either side of the cylinder block 18 from the crankcase cover 22 to a respective cylinder head 16*a* or 16*b*. The intake runners 24*a*, 24*b* extend from a surge take or silencer 26 located fore of the crankcase cover 22 and around the outside of the cylinder banks 19*a*, 19*b*. One intake runner 24*a* or 24*b* is provided for each of the four cylinders 20*a* or 20*b*. Thus, each intake runner 24*a*, 24*b* provides intake air to a respective intake passage 38*a* or 38*b*, which intake passage 38*a* or 38*b* extends through the cylinder head 16*a* or 16*b* to a respective cylinder 20*a*, 20*b*, as will be described further herein below. Two fuel rails 28*a*, 28*b* are provided to carry fuel to the intake passages 38*a*, 38*b* in the cylinder heads 16*a*, 16*b*. Each fuel rail 28*a*, 28*b* extends along a respective vertical center axis 30*a*, 30*b* alongside the engine body and is located between an outer surface of the engine body and an inner surface 32 of the cowl 14.

Thus, an outboard motor internal combustion engine 12 according to the present disclosure includes a cylinder block 18 including a plurality of vertically stacked cylinders 20*a*, 20*b* that are divided into first and second cylinder banks 19*a*, 19*b* arranged in a V-shape. First and second cylinder heads 16*a*, 16*b* are coupled to the first and second cylinder banks 19*a*, 19*b*, respectively, near a first end 60 of the engine 12, the first and second cylinder heads 16*a*, 16*b* defining a plurality of intake passages 38*a*, 38*b*, each intake passage 38*a*, 38*b* in the plurality of intake passages corresponding to a respective cylinder 20*a*, 20*b* in the plurality of cylinders. First and second air intake manifolds 25*a*, 25*b* including a plurality of air intake runners 24*a*, 24*b* extend from a second, opposite end 62 of the engine 12, around first and second sides of the cylinder block 18 (i.e., around outer lateral sides of the cylinder banks 19*a*, 19*b*), and are respectively connected to the intake passages 38*a*, 38*b* in the first and second cylinder heads 16*a*, 16*b*. First and second vertically extending fuel rails 28*a*, 28*b* are respectively located between the first cylinder head 16*a* and the first air intake manifold 25*a* and between the second cylinder head 16*b* and the second air intake manifold 25*b*. The fuel rails 28*a*, 28*b* are also located on the outer side of the cylinder head 16*a*, 16*b* and the intake manifold 25*a*, 25*b*, i.e. between those structures and the inner surface 32 of the cowl 14.

The fuel delivery system 33 for the engine 12 includes a fuel source 34 that is in fluid communication with the fuel rails 28*a*, 28*b* by way of a fuel filter 35 and a fuel pump 36. This may be through a variety of different hoses, tubes, and the like. Additionally, a fuel reservoir, a high pressure pump, a low pressure pump, vapor separator, fuel supply module, and/or pressure sensors may be provided as part of the fuel delivery system 33 as known to those having ordinary skill in the art. Fuel return lines may also be provided to return fuel to the fuel source 34. The exact components and layout provided for the fuel source, reservoir, pump(s), etc. are ancillary to the details of the fuel delivery system 33 of the present disclosure, and are not limiting on the scope of the present claims. Briefly, in the example shown, the fuel pump 36 provides fuel at high pressure to each of the vertically extending fuel rails 28*a*, 28*b*, after which the flow of fuel is guided through receiver cups and fuel injectors of the fuel delivery system 33, as will be described below. The fuel rail can be made of metal or plastic, and the receiver cups and fuel injectors can be made of plastic.

Figure 3:
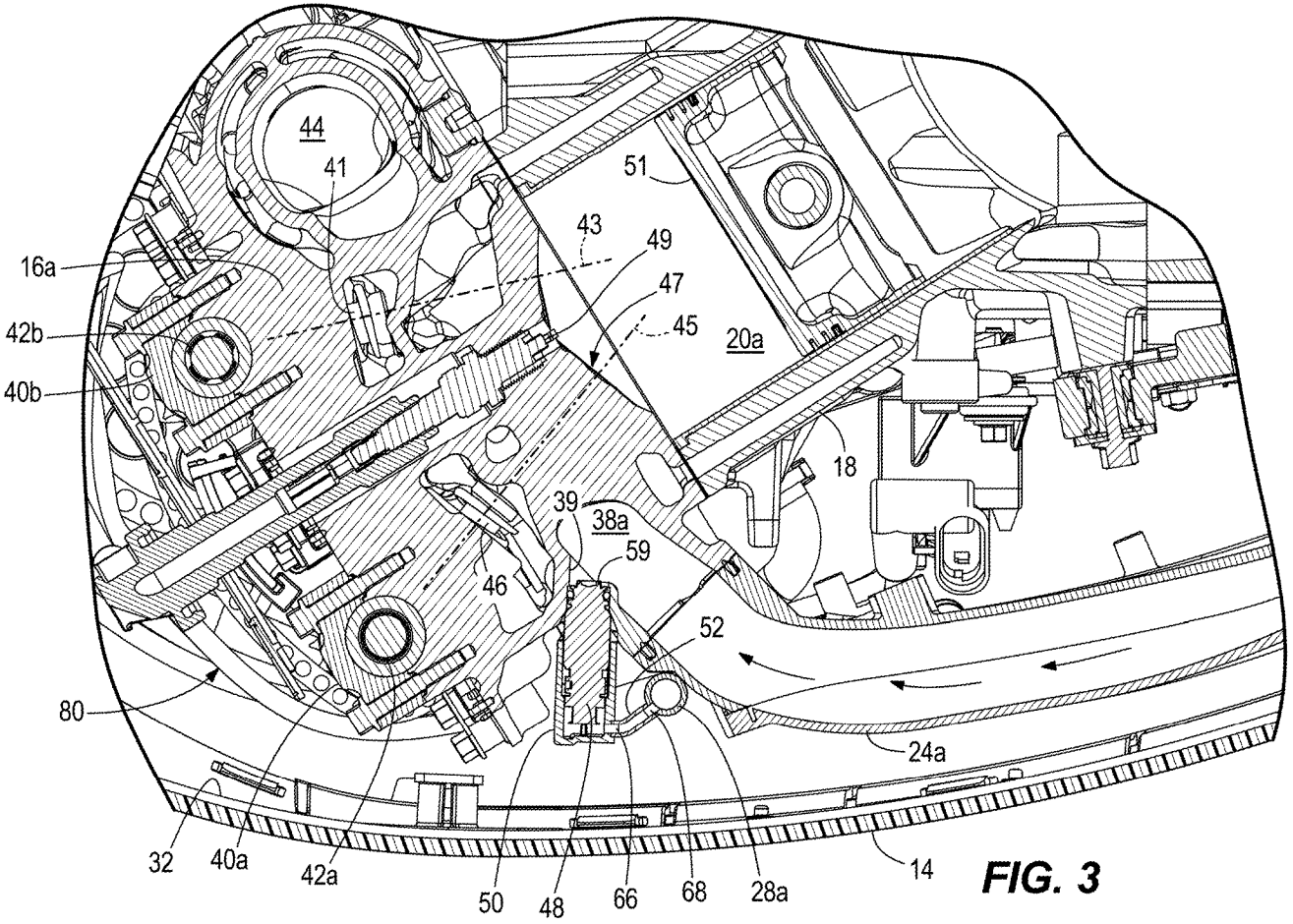
FIG. 3 illustrates a detailed view of portions of a cylinder head, a cylinder block, and a fuel delivery system according to the present disclosure.

As mentioned above, the engine 12 includes a plurality of intake passages 38*a*, 38*b*, each intake passage 38*a*, 38*b* extending through a respective cylinder head 16*a*, 16*b* to a respective cylinder 20*a*, 20*b*. One of the intake passages 38*a* is shown in more detail in FIG. 3, which shows a partial, cross-sectional view of the engine 12 at starboard-side cylinder bank 19*a*. It should be understood that a similar description applies to the components located in cylinder bank 19*b*, although such components will not be described in detail for purposes of brevity. As shown in FIG. 3, cam covers 40*a*, 40*b* hold cam shafts 42*a*, 42*b* within the cylinder head 16*a*. Cam shaft 42*a* opens and closes a spring-biased intake valve that provides selective communication between the cylinder 20*a* and intake passage 38*a*. Cam shaft 42*b* opens and closes a spring-biased exhaust valve that provides selective communication between the cylinder 20*a* and exhaust passage 44. Although the intake valve between intake passage 38*a* and cylinder 20*a* cannot be fully seen in FIG. 3, a valve stem 46 that couples the intake valve to the cam shaft 42*a* is shown, which valve stem 46 extends along centerline 45. Additionally, the intake valve face 47 can be seen just at the opening where the intake passage 38*a* leads into the cylinder 20*a*. Similarly, exhaust valve stem 41, extending along centerline 43, can be seen within cylinder head 16*a*. A cylinder head cover 80 extends over the cam covers 40*a*, 40*b* and other cylinder head components.

Intake air travels through the intake runner 24*a* as shown by the direction of the arrows therein, enters the intake passage 38*a*, and thereafter enters the cylinder 20*a* upon retraction of the intake valve face 47 from the opening that leads into the cylinder 20*a*. Fuel is injected into the stream of air prior to its entry into cylinder 20*a* by a fuel injector 48, the coupling of which to fuel rail 28*a* will be described further herein below. Although only one intake passage 38*a* and fuel injector 48 are shown herein, it should be understood that the same assembly is provided at the cylinder above or below the one shown in FIG. 3, and that a mirror image of the assembly is provided in the opposite cylinder bank 19*b*. In fact, referring to FIGS. 1-3, a plurality of fuel injectors 48 are coupled to the first and second fuel rails 28*a*, 28*b* and are vertically spaced from one another with respect to each fuel rail 28*a*, 28*b* such that a receiver cup 50 of each fuel injector 48 in the plurality of fuel injectors is associated with a respective cylinder 20*a*, 20*b*. Each receiver cup 50 includes a sealing surface for an o-ring around the fuel injector 48 and provides means for clamping the receiver cup 50 to the outer surface of the cylinder head 16*a* or 16*b*.

Returning to FIG. 3, each fuel injector 48 has a nozzle end 59 that extends into a respective intake passage 38*a*, 38*b* corresponding to a respective cylinder 20*a*, 20*b*. The nozzle end 59 of each fuel injector 48 communicates with a respective intake passage (e.g., 38*a* in FIG. 3) and thereby injects fuel into the intake passage 38*a* upstream of the intake valve. The nozzle end 59 of the fuel injector 48 may fully extend into the intake passage 38*a*, or could instead be located in a side passage 39 within the cylinder head 16*a* that connects to the intake passage 38*a*. In the example shown herein, a portion of the nozzle end 59 extends into the intake passage 38*a*, while the remainder of the nozzle end 59 is located within the side passage 39. In any case, the engine 12 therefore operates using indirect injection, as fuel is injected into the air stream upstream of the intake valve. After the fuel-air mixture from the intake passage 38*a* enters the cylinder 20*a*, a spark plug 49 ignites the mixture, which upon combustion causes a piston 51 within the cylinder 20*a* to be pushed toward the crankshaft 53 (FIG. 2) of the engine 12. The pattern with which such combustion events take place is known to those having ordinary skill in the art, and in this example is a 4-stroke pattern, although engines that operate according to a 2-stroke pattern are contemplated within the scope of the present disclosure.

According to the present disclosure, the first and second fuel rails 28*a*, 28*b* are integral with either the first and second cylinder heads 16*a*, 16*b*, respectively, or with the first and second air intake manifolds 25*a*, 25*b*, respectively. For example, FIGS. 1-3 and 8-9 show various examples of fuel rails being integrated into the intake manifold 25*a* or 25*b*, while FIGS. 4-7 show examples of fuel rails being integrated into the cylinder head 16*a* or 16*b*. Various connection structures, geometries of the fuel rail, and other details of fuel delivery systems will be described herein below. Each of the below examples depicts and describes a plurality of feeder tubes, each feeder tube in the plurality of feeder tubes corresponding to a respective fuel injector 48, wherein the feeder tubes couple the fuel injectors 48 to the first and second fuel rails, respectively. In the examples shown herein, the fuel injectors 48 are top-feed fuel injectors, but the designs could be modified to work with side-feed fuel injectors instead. Additionally, note that according to the layout of the remainder of the fuel delivery system 33 shown in FIG. 1, fuel flows from respective bottom ends of the first and second fuel rails to respective top ends of the first and second fuel rails, such as from bottom ends 29*a*, 29*b* to top ends 31*a*, 31*b* of fuel rails 28*a*, 28*b*.

Figure 4:
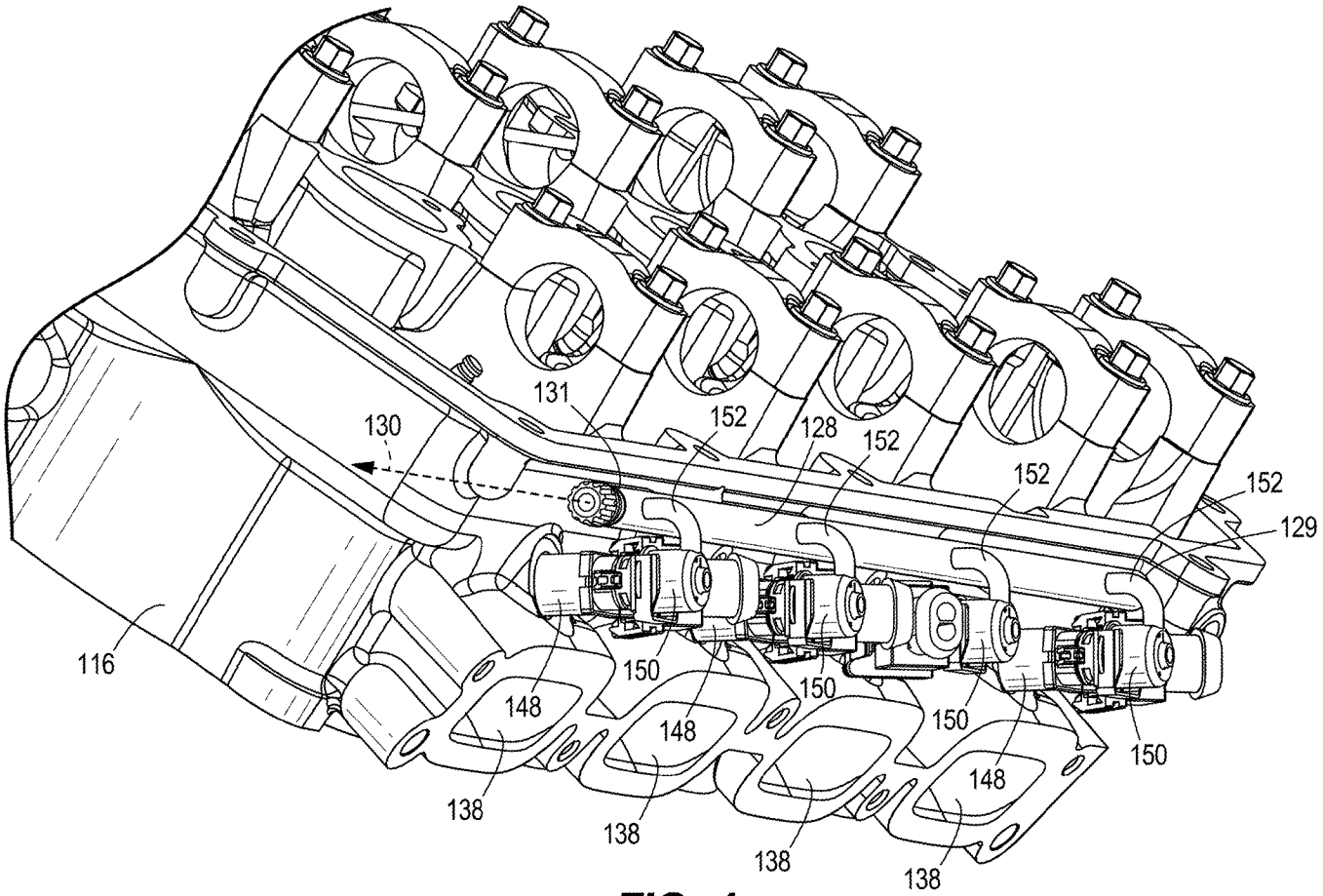
FIG. 4 illustrates a perspective view of an alternative embodiment of a portion of a fuel delivery system according to the present disclosure.

FIG. 4 shows an alternative embodiment of a portion of a fuel delivery system according to the present disclosure, including fuel rail 128 having bottom end 129 and top end 131. Receiver cups 150 are coupled to the fuel rail 128 and spaced from one another with respect to a rail center axis 130 such that each receiver cup 150 is associated with a respective cylinder (not shown) in a cylinder block having four vertically stacked cylinders. Thus, the structure shown in part is the cylinder head 116 on the port side of a V-8 engine with two banks of four cylinders each. Although the cylinders are not shown, the intake passages 138 associated with each cylinder are shown for purposes of orienting the viewer. Each receiver cup 150 has a respective feeder tube 152 that extends between the respective receiver cup 150 and the fuel rail 128. The feeder tubes 152 are individual feeder tubes that can be integral with or connected to the receiver cups 150. Fuel injectors 148 are respectively coupled to the receiver cups 150. In this example, the fuel rail 128 is provided between the cam area and the fuel injectors 148, and is integral with the cylinder head 116.

Figure 5:
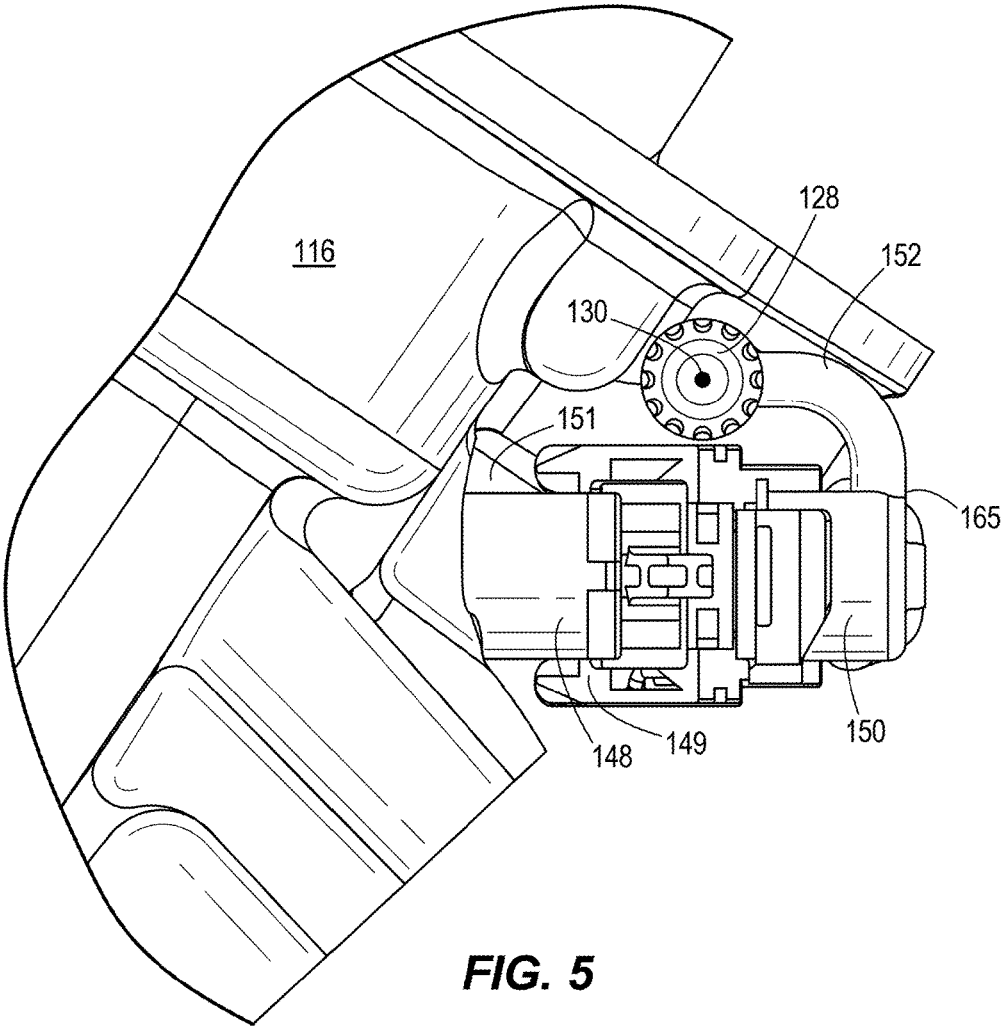
FIG. 5 illustrates a top view of the portion of the fuel delivery system of FIG. 4.

FIG. 5 shows a top view of the embodiment of FIG. 4, including the location of a port 165 between the feeder tube 152 and the receiver cup 150. The receiver cups 150 each have a fitting (such as a barbed nipple) to mate with the feeder tube 152, an interface 151 to rigidly attach the receiver cup 150 to the cylinder head 116, and an interference or snap-fit feature 149 to engage and retain the fuel injector 148.

Figure 6:
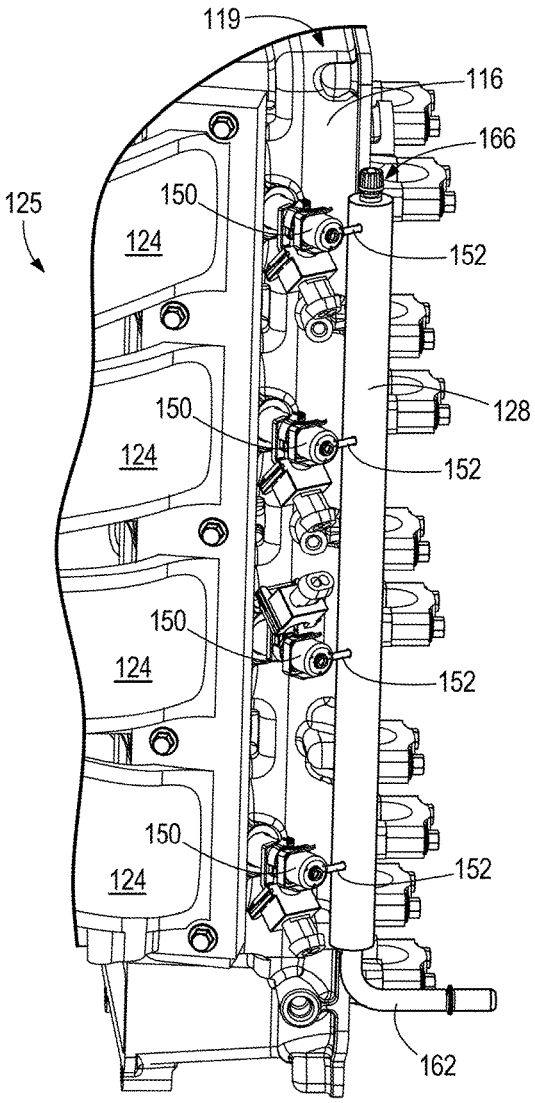
FIG. 6 illustrates an embodiment of a portion of a fuel delivery system similar to that of FIGS. 4 and 5.
Figure 6A:
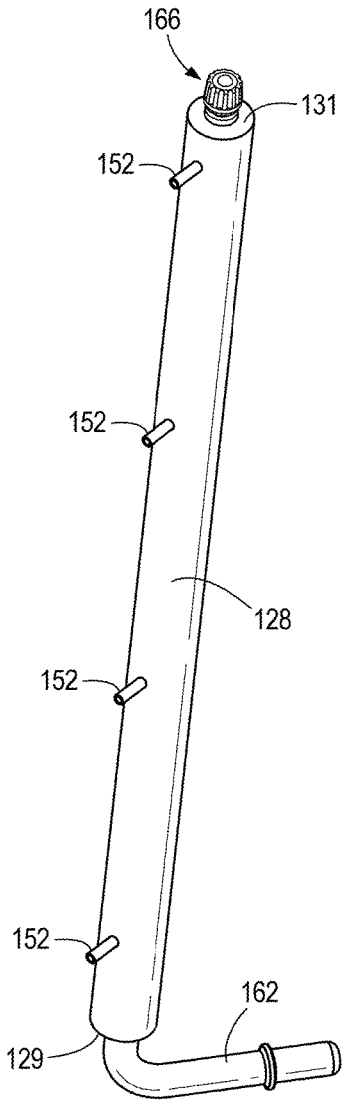
FIG. 6A illustrates a detailed view of a portion of FIG. 6.

FIGS. 6 and 6A show an embodiment very similar to the example of FIGS. 4 and 5. Note that the fuel rail 128 is integral with the cylinder head 116 on the port side of a V-8 engine, which includes intake runners 124 of intake manifold 125. For example, the fuel rail 128 can be located on the outside edge of the cylinder head 116, running vertically along its height. A fuel delivery line 162, which is ultimately in communication with a fuel pump (see 36, FIG. 1) delivers fuel into the cylindrical fuel rail 128. The delivery line 162 is connected to the bottom end 129 of the fuel rail 128, and fuel flows from the bottom end 129 to the top end 131 of the fuel rail 128. Fuel is fed to the injectors via receiver cups 150, which receive the fuel via feeder tubes 152. A service port connection and air bleed location 166 is located at the highest point along the fuel rail 128, at the top end 131. The fuel rail 128 in this example is rotated slightly from the example shown in FIGS. 4 and 5, such that the feeder tubes 152 do not need to be bent to connect to the appropriate location on the receiver cup 150. It should be understood that the orientation of a given fuel injector and its receiver cup 150 can be changed to fit the space limitations of a particular engine, and the feeder tube 152 can be manipulated or bent as required to connect the fuel rail 128 to the receiver cup 150.

Figure 7:
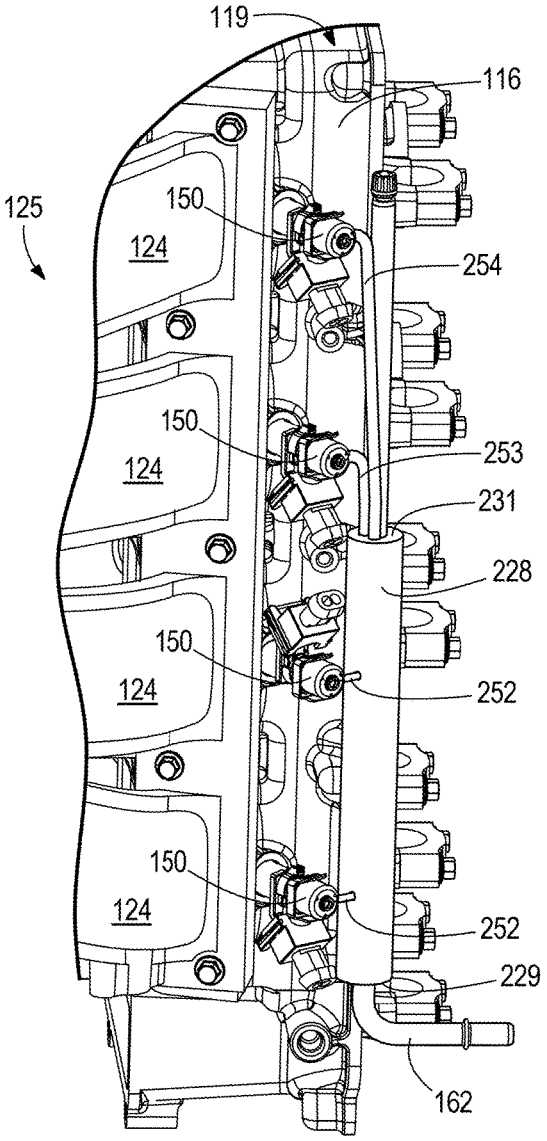
FIG. 7 illustrates an alternative embodiment of a portion of a fuel delivery system according to the present disclosure.
Figure 7A:
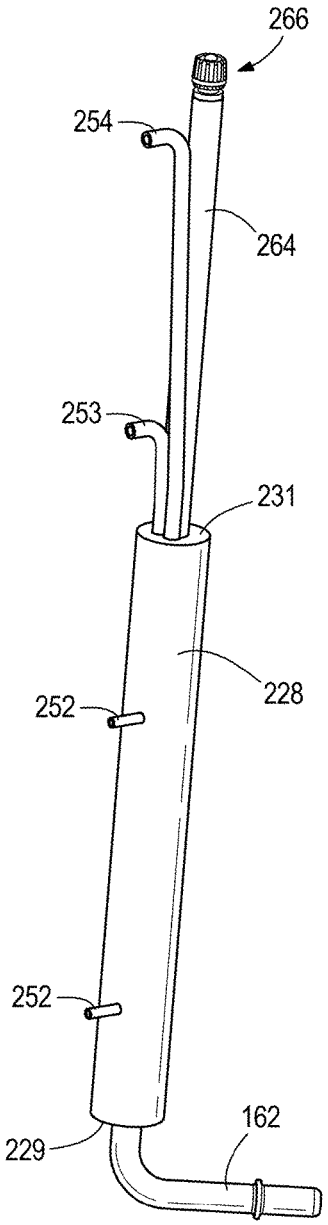
FIG. 7A illustrates a detailed view of a portion of FIG. 7.

FIGS. 7 and 7A show another example of a fuel rail 228 that is integral with the cylinder head 116 on the port side of a V-8 engine, which includes intake runners 124 of intake manifold 125. A fuel delivery line 162, which is ultimately connected to a fuel pump (see 36, FIG. 1) delivers fuel into the cylindrical fuel rail 228. The delivery line 162 is connected to the bottom end 229 of the fuel rail 228, and fuel flows from the bottom end 229 to the top end 231 of the fuel rail 228. Fuel is fed to the injectors via receiver cups 150, which receive the fuel via feeder tubes 252, at least for the lowermost fuel injectors. That is because in this example the fuel rail 228 extends vertically alongside only a lower subset of the cylinders in the respective cylinder bank 119. The top end 231 of the fuel rail 228 ends about halfway up the cylinder bank 119. Feeder tubes 253 and 254 extend from the top end 231 of the fuel rail 228 and connect to the receiver cups 150 for each of the uppermost fuel injectors in the cylinder bank 119. Thus, the feeder tubes 253, 254 corresponding to an upper subset of the cylinders (here, the uppermost two cylinders) in the cylinder bank 119 extend from the top end 231 of the respective fuel rail 228. Feeder tube 253 is shorter than feeder tube 254, as it extends less far. In another example, the lower subset of cylinders includes the lower three cylinders, while the upper subset of cylinders includes just the uppermost cylinder. The opposite grouping may also be made, with the lowermost cylinder being the lower subset along which the fuel rail 228 extends, and the three upper cylinders being the upper subset fed by longer feeder tubes. In another example, the longer feeder tubes connected to the receiver cups 150 and feeding the upper subset of cylinders are connected not to the top end 231 of the fuel rail 228, but to the side of the fuel rail 228.

With reference to FIG. 7A, the example shown herein has a tube 264 that extends from the top end 231 of the fuel rail 228 and that provides for a service port connection and air bleed location 266. This is the highest point in the fuel system and where the air will be located. In another example, this location 266 is at the top end 231 of the fuel rail 228. The feeder tubes 253 and 254 and tube 264 can be connected to the top end 231 of the fuel rail 228 by way of a specially designed end cap, O rings, and/or barbed nipple-like fittings.

Figure 8:
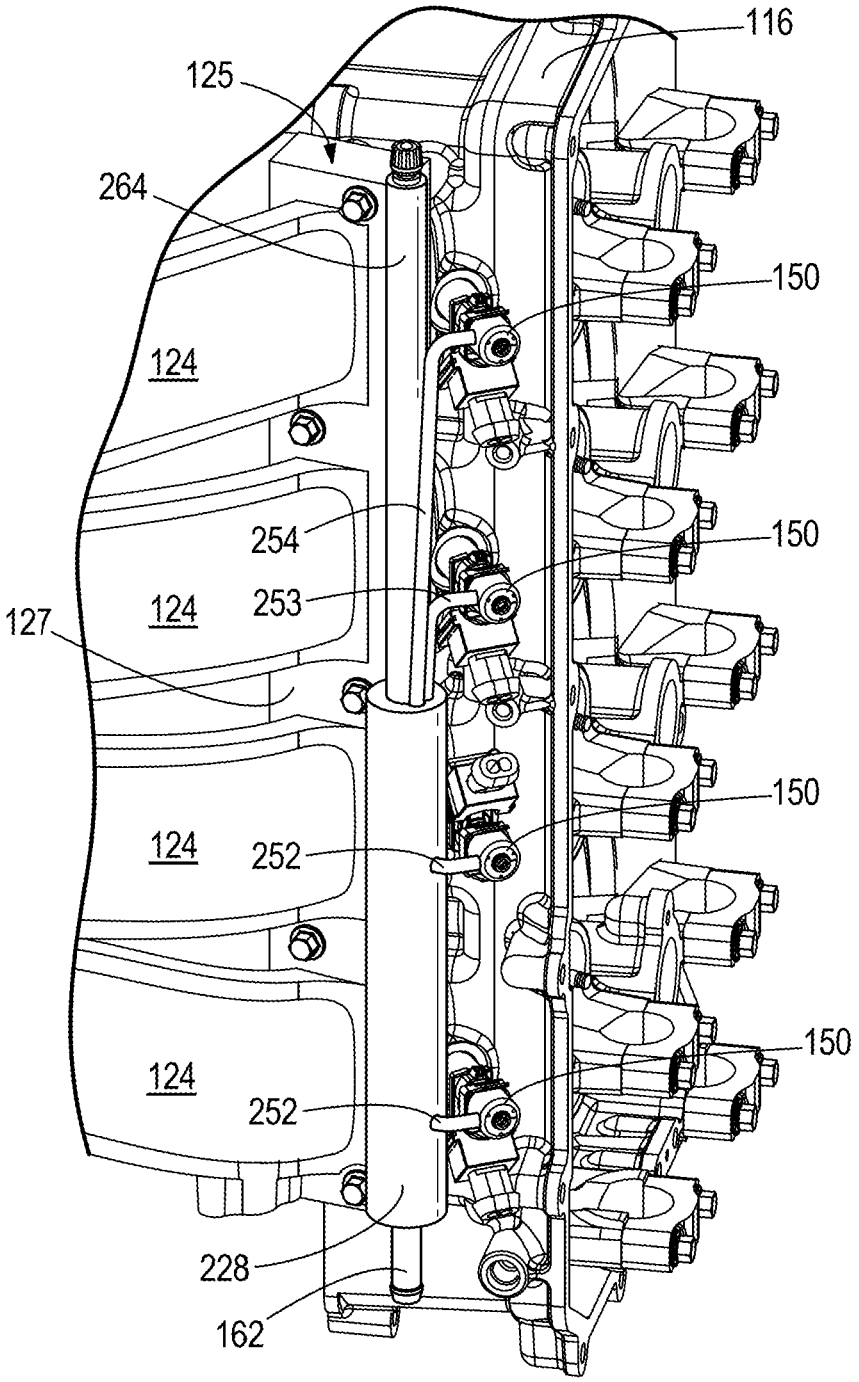
FIG. 8 illustrates an alternative embodiment of a portion of a fuel delivery system according to the present disclosure.

FIG. 8 shows an example in which the fuel rail 228 of FIGS. 7 and 7A is integrated into the intake manifold 125 instead of the cylinder head 116. More specifically, the fuel rail 228 is integral with a flange 127 of the intake manifold 125 that is bolted to the cylinder head 116. The fuel rail 228 can be located on the intake manifold flange 127 between the intake manifold 125 and the cam cover (not shown here, but see FIG. 3). Shorter feeder tubes 252 and longer feeder tubes 253, 254 are connected to opposite sides of the receiver cups 150, but otherwise the assembly is much the same as that shown and described with respect to FIG. 7.

Figure 9:
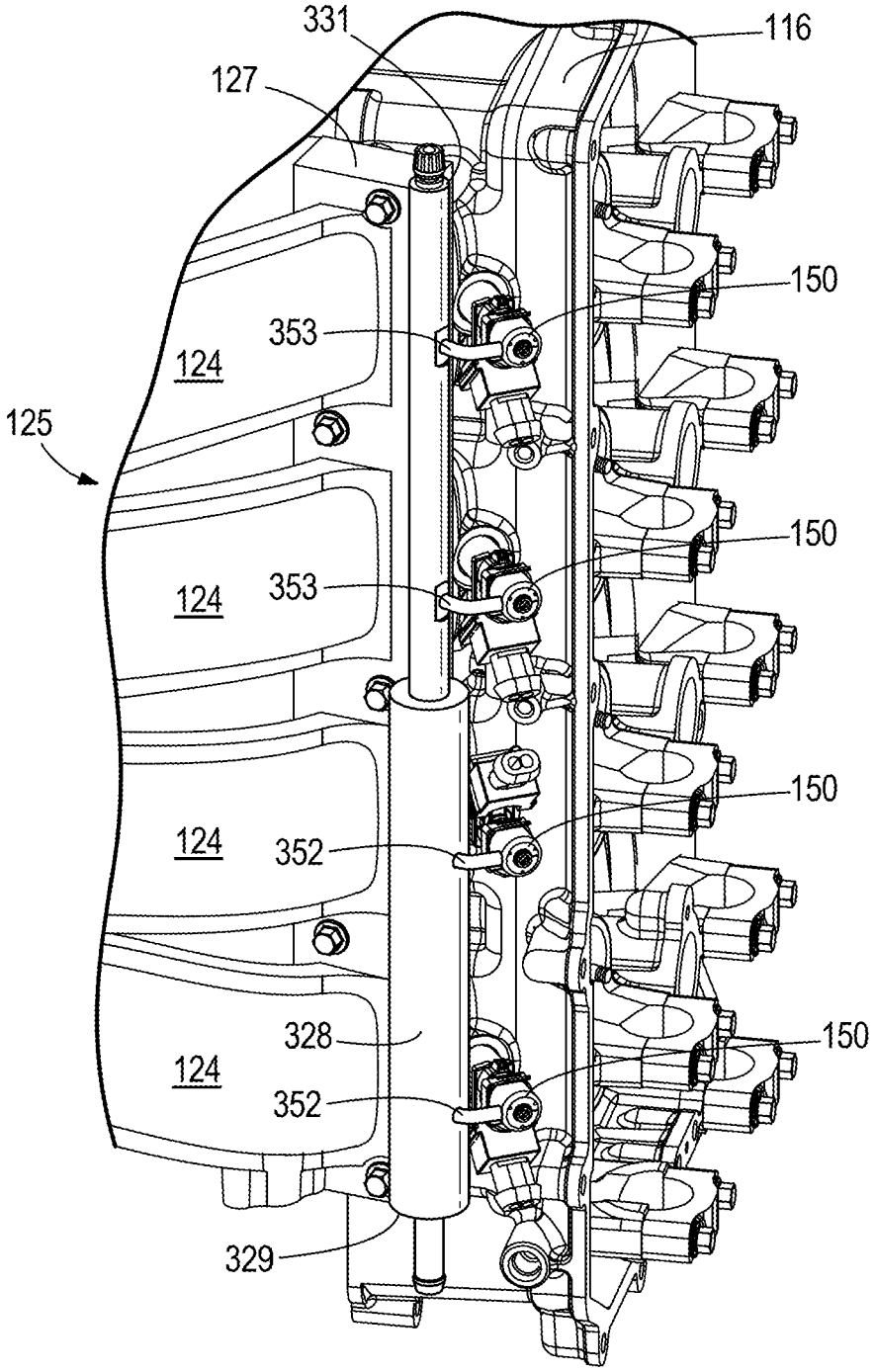
FIG. 9 illustrates an alternative embodiment of a portion of a fuel delivery system according to the present disclosure.
Figure 9A:
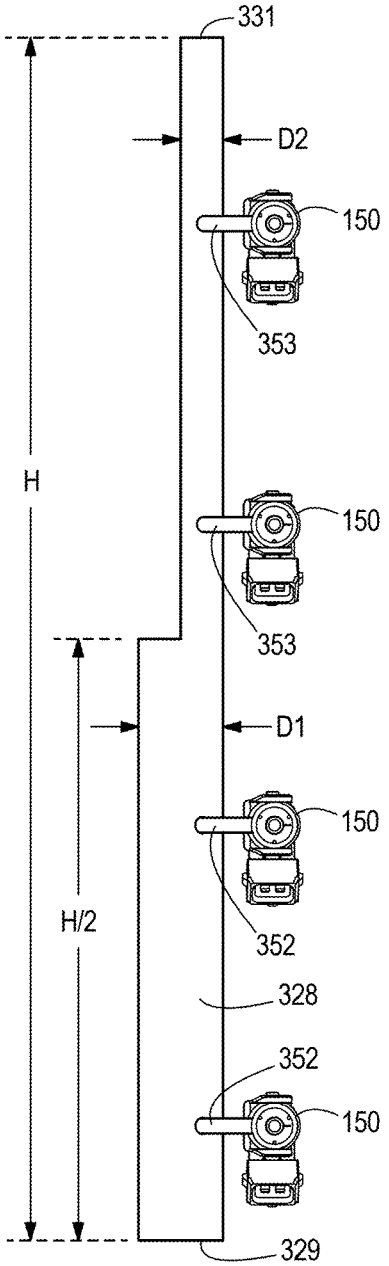
FIG. 9A illustrates a detailed view of a portion of FIG. 9.

FIGS. 9 and 9A show an example in which a fuel rail 328 is also coupled to the flange 127 of the intake manifold 125 instead of to the cylinder head 116. Here, the fuel rail 328 has a diameter that decreases from the bottom end 329 of the fuel rail 328 to the top end 331 of the fuel rail 328. Compare diameter D1 with diameter D2. In fact, in the example shown, the diameter of the fuel rail 328 decreases approximately halfway along a height of the respective fuel rail 328. Compare total height H of the fuel rail 328 shown in FIG. 9A to half of the height H/2. Note that the diameter change could occur anywhere between the locations where feeder tube 352 (connected to the second from bottom receiver cup 150) and feeder tube 353 (connected to the third from bottom receiver cup 150) are connected to the fuel rail 328, and the design would still achieve the same objective and provide the same functionality. Thus, approximately halfway along the height encompasses anywhere between these two connection points. Depending on the orientation of the upper portion or half of the fuel rail 328, the feeder tubes 353 leading to the upper receiver cups 150 may need to be longer than the feeder tubes 352 leading to the lower two receiver cups 150.

Figure 10:
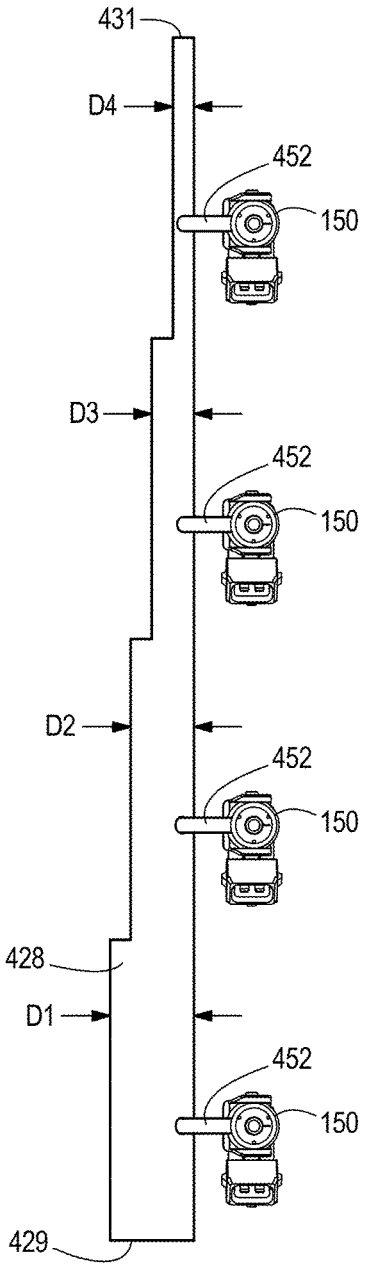
FIG. 10 illustrates an alternative embodiment of a portion of a fuel delivery system according to the present disclosure.

FIG. 10 shows another example of a fuel rail 428 in which the diameter decreases from the bottom end 429 to the top end 431. Here, there are three steps down in diameter, from D1 to D2, from D2 to D3, and from D3 to D4. Again, the feeder tubes 452 might need to increase in length as the diameter decreases, depending on the orientation of the fuel rail 428 with respect to the receiver cups 150. Note also that the portion of the fuel rail 428 having the diameter D4 could instead be a feeder tube, similar to the embodiment shown in FIGS. 7 and 7A.

The decrease in diameter in each of FIGS. 9 and 10 and the use of longer feeder tubes in FIGS. 7 and 8 is achievable because the fuel flow requirements decrease as fuel is delivered to each fuel injector 148 in turn. While the fuel rail generally provides a common fuel volume that stabilizes accumulated pressure, the flow requirements at the top of the fuel rail are much less than those at the bottom, where enough fuel must flow to reach each of the above fuel injectors. Stepping down the diameter of the fuel rail or using feeder tubes that branch off the top end of the fuel rail allows the overall engine assembly to be narrower near its top, which helps comply with cowl pull-off requirements. Said another way, the overall height of the fuel injector is decreased when measured along the axis of the injector.

In each of the above examples, the feeder tubes are flexible tubes, such as for example made of plastic, and more specifically of nylon. This allows for the receiver cups 150 to be positioned with respect to the cylinder head 16, 116 independently of the fuel rail. The fuel rail and the receiver cups 150 can both be provided with a barbed nipple-like fitting that leads into the respective passage through which fuel is to flow. The feeder tubes can be slid over the barbed fittings, one end of the feeder tube on each barbed fitting, to make the connection between the fuel rail and the receiver cups 150. An example of the barbed fittings is shown in FIG. 3 at 66 and 68. The barbed fitting 66 can be molded as part of the receiver cup 50 or can be installed as a separate piece. The barbed fitting 68 can be molded as part of the fuel rail 28*a* or can be installed as a separate piece. In either case, the thin walled nylon feeder tube 52 will fit snugly over the barbed fittings 66, 68 without fuel leakage. The flexibility of the feeder tubes also allows the connection of the feeder tube 52 to the fuel rail 28*a* to be in a different horizontal and/or vertical plane than the connection to the receiver cup 50, thereby reducing design constraints. This same characteristic and resulting benefit applies to all of the examples noted herein above.

Thus, as a result of the specific geometry, components, and layout of the above-mentioned fuel delivery system 33, the problem of spatial integration of a fuel rail assembly including a fuel rail, fuel injectors, electrical connectors, and associated mounting hardware and interfaces, either into and/or between base engine components, peripheral components, and cowl components can be solved. While a given distance needs to remain between the nozzle end 59 of the fuel injector 48 and the face 47 of the intake valve in order to provide enough distance for the fuel to mix with the intake air before entering the cylinder 20*a*, 20*b*, the distance shown herein has been tested and proves to be sufficient for good fuel economy and acceptable emissions.

In any of the above examples, the electrical components can be integrated into the fuel rail and associated components. For example, ribbons of electrically conductive material are disposed on the fuel rail frame along with integral connectors to interface with each fuel injector 48, 148 and a wiring harness connector.

Note also that in each of the above examples, the fuel injectors 48, 148 are top-feed fuel injectors. This means that the fuel rails shown herein are not in-line with the receiver cups or fuel injectors, and fuel enters each fuel injector 48, 148 from an end opposite its nozzle end 59. However, despite the fuel injectors being top-fed, the feeder tubes connect to the receiver cups 50, 150 at the side, not the top, of the receiver cup 50, 150. For example, each feeder tube is coupled to a respective fuel injector receiver cup 50, 150 perpendicular to a longitudinal center axis of the respective fuel injector. Fuel therefore flows into the receiver cup 50, 150 in a first direction, and then flows through the injector 48, 148 in another direction, perpendicular to the first. This change in fuel direction allows the fuel injector, receiver cup, and feeder tube assembly to have a low profile, meaning the cowl 14 can be closer to the engine body and the outboard motor is minimized in width. The flexibility of the feeder tubes also allows for the connections to the sides of the receiver cups 50, 150.

Finally, note that although the different embodiments of fuel rails are shown with respect to only one cylinder bank of the engine, a mirror image of a given fuel rail is provided on the other cylinder bank.

In the above description, certain terms have been used for brevity, clarity, and understanding. No unnecessary limitations are to be inferred therefrom beyond the requirement of the prior art because such terms are used for descriptive purposes and are intended to be broadly construed. The different systems described herein may be used alone or in combination with other systems. It is to be expected that various equivalents, alternatives and modifications are possible within the scope of the appended claims.

What is claimed is:

1. An outboard motor internal combustion engine comprising:

a cylinder block including a plurality of vertically stacked cylinders that are divided into first and second cylinder banks arranged in a V-shape;

first and second cylinder heads coupled to the first and second cylinder banks, respectively, near a first end of the engine, the first and second cylinder heads defining a plurality of intake passages, each intake passage in the plurality of intake passages corresponding to a respective cylinder in the plurality of cylinders;

first and second air intake manifolds including a plurality of air intake runners that extend from a second, opposite end of the engine, around first and second sides of the cylinder block, and are respectively connected to the intake passages in the first and second cylinder heads;

first and second vertically extending fuel rails respectively located between the first cylinder head and the first air intake manifold and between the second cylinder head and the second air intake manifold, wherein the first and second fuel rails are integral with either the first and second cylinder heads, respectively, or the first and second air intake manifolds, respectively;

a plurality of fuel injectors coupled to the first and second fuel rails and vertically spaced from one another with respect to each fuel rail such that each fuel injector in the plurality of fuel injectors is associated with a respective cylinder, each fuel injector having a nozzle end that injects fuel into a respective intake passage corresponding to the respective cylinder, wherein the fuel injectors are top-feed fuel injectors; and a plurality of feeder tubes, each feeder tube in the plurality of feeder tubes corresponding to a respective fuel injector, wherein the feeder tubes couple the fuel injectors to the first and second fuel rails, respectively;

wherein fuel flows from respective bottom ends of the first and second fuel rails to respective top ends of the first and second fuel rails, and wherein each of the first and second fuel rails has a diameter that decreases from the bottom end of the fuel rail to the top end of the fuel rail.

2. The outboard motor internal combustion engine of claim 1, wherein the diameter of each of the first and second fuel rails decreases approximately halfway along a height of the respective fuel rail.

3. An outboard motor internal combustion engine comprising:

a cylinder block including a plurality of vertically stacked cylinders that are divided into first and second cylinder banks arranged in a V-shape;

first and second cylinder heads coupled to the first and second cylinder banks, respectively, near a first end of the engine, the first and second cylinder heads defining a plurality of intake passages, each intake passage in the plurality of intake passages corresponding to a respective cylinder in the plurality of cylinders;

first and second air intake manifolds including a plurality of air intake runners that extend from a second, opposite end of the engine, around first and second sides of the cylinder block, and are respectively connected to the intake passages in the first and second cylinder heads;

first and second vertically extending fuel rails respectively located between the first cylinder head and the first air intake manifold and between the second cylinder head and the second air intake manifold, wherein the first and second fuel rails are integral with either the first and second cylinder heads, respectively, or the first and second air intake manifolds, respectively;

a plurality of fuel injectors coupled to the first and second fuel rails and vertically spaced from one another with respect to each fuel rail such that each fuel injector in the plurality of fuel injectors is associated with a respective cylinder, each fuel injector having a nozzle end that injects fuel into a respective intake passage corresponding to the respective cylinder, wherein the fuel injectors are top-feed fuel injectors; and a plurality of feeder tubes, each feeder tube in the plurality of feeder tubes corresponding to a respective fuel injector, wherein the feeder tubes couple the fuel injectors to the first and second fuel rails, respectively;

wherein fuel flows from respective bottom ends of the first and second fuel rails to respective top ends of the first and second fuel rails, and wherein the first and second fuel rails extend vertically alongside only a lower subset of the cylinders in the respective first and second cylinder banks.

4. The outboard motor internal combustion engine of claim 3, wherein the feeder tubes corresponding to an upper subset of the cylinders in the respective first and second cylinder banks extend from the top ends of the respective first and second fuel rails.

5. The outboard motor internal combustion engine of claim 1, wherein the feeder tubes are flexible tubes.

6. The outboard motor internal combustion engine of claim 5, wherein the flexible tubes are made of nylon.

7. The outboard motor internal combustion engine of claim 5, wherein each feeder tube is coupled to a respective fuel injector perpendicular to a longitudinal center axis of the respective fuel injector.

8. An outboard motor internal combustion engine comprising:

a cylinder block including a plurality of vertically stacked cylinders that are divided into first and second cylinder banks arranged in a V-shape;

first and second cylinder heads coupled to the first and second cylinder banks, respectively, near a first end of the engine and defining intake passages corresponding to each of the cylinders;

first and second fuel rails extending vertically alongside the engine;

fuel injectors coupled to the first and second fuel rails and vertically spaced from one another with respect to each fuel rail such that each fuel injector is associated with a respective cylinder, each fuel injector having a nozzle end that injects fuel into a respective intake passage corresponding to the respective cylinder; and flexible feeder tubes extending from the first and second fuel rails, respectively, each feeder tube being connected to a respective fuel injector;

wherein the fuel injectors are top-feed fuel injectors and each feeder tube is coupled to a respective fuel injector perpendicular to a longitudinal center axis of the respective fuel injector.

9. The outboard motor internal combustion engine of claim 8, further comprising first and second air intake manifolds including a plurality of air intake runners that extend from a second, opposite end of the engine, around first and second sides of the cylinder block, and are respectively connected to the intake passages in the first and second cylinder heads.

10. The outboard motor internal combustion engine of claim 9, wherein the first fuel rail is located between the first cylinder head and the first air intake manifold and the second fuel rail is located between the second cylinder head and the second air intake manifold.

11. The outboard motor internal combustion engine of claim 10, wherein the first and second fuel rails are integral with either the first and second cylinder heads, respectively, or the first and second air intake manifolds, respectively.

12. The outboard motor internal combustion engine of claim 11, wherein fuel flows from respective bottom ends of the first and second fuel rails to respective top ends of the first and second fuel rails, and wherein each of the first and second fuel rails has a diameter that decreases from the bottom end of the fuel rail to the top end of the fuel rail.

13. The outboard motor internal combustion engine of claim 12, wherein the diameter of each of the first and second fuel rails decreases approximately halfway along a height of the respective fuel rail.

14. The outboard motor internal combustion engine of claim 11, wherein fuel flows from respective bottom ends of the first and second fuel rails to respective top ends of the first and second fuel rails, and wherein the first and second fuel rails extend vertically alongside only a lower subset of the cylinders in the respective first and second cylinder banks.

15. The outboard motor internal combustion engine of claim 14, wherein feeder tubes corresponding to an upper subset of the cylinders in the respective first and second cylinder banks extend from the top ends of the respective first and second fuel rails.

16. The outboard motor internal combustion engine of claim 8, wherein the feeder tubes are made of plastic.

17. The outboard motor internal combustion engine of claim 16, wherein the plastic comprises nylon.

18. The outboard motor internal combustion engine of claim 3, wherein the feeder tubes are flexible tubes.

19. The outboard motor internal combustion engine of claim 18, wherein the flexible tubes are made of nylon.

20. The outboard motor internal combustion engine of claim 18, wherein each feeder tube is coupled to a respective fuel injector perpendicular to a longitudinal center axis of the respective fuel injector.

* * * * *